United States Patent [19]

Tinnes

[11] 4,327,847

[45] May 4, 1982

[54] SLIDING GATE NOZZLES

[75] Inventor: Bernhard J. Tinnes, Zollikerberg, Switzerland

[73] Assignee: Didier-Werke AG, Wiesbaden, Fed. Rep. of Germany

[21] Appl. No.: 924,754

[22] Filed: Jul. 14, 1978

[30] Foreign Application Priority Data

Jul. 26, 1977 [DE] Fed. Rep. of Germany ..... 2733665

[51] Int. Cl.[3] ..... B22D 41/08; B22D 41/10

[52] U.S. Cl. ..... 222/591; 222/600

[58] Field of Search ..... 222/559, 561, 600, 591; 106/58 (U.S. only)

[56] References Cited

U.S. PATENT DOCUMENTS 3,395,831 8/1968 Minteer, Jr. ..... 222/591

3,841,539 10/1974 Shapland, Jr. ..... 222/600

FOREIGN PATENT DOCUMENTS 850627 7/1977 Belgium ..... 222/600

873283 7/1961 United Kingdom ..... 222/591

*Primary Examiner*—David A. Scherbel

*Attorney, Agent, or Firm*—Stevens, Davis, Miller & Mosher

[57] ABSTRACT

There is disclosed an interchangeable refractory wearing part having a flow aperture for molten metal for a metallurgical vessel or a bottom gate therefor, such as a bottom brick, a nozzle brick, a collector nozzle, a fixed plate, a sliding plate or an immersion nozzle or a choke, made of refractory concrete reinforced with metal parts which are disposed on the surface of the part remote from the flow aperture and are adapted to center and position the part in the gate or in the vessel.

9 Claims, 18 Drawing Figures

Fig.6
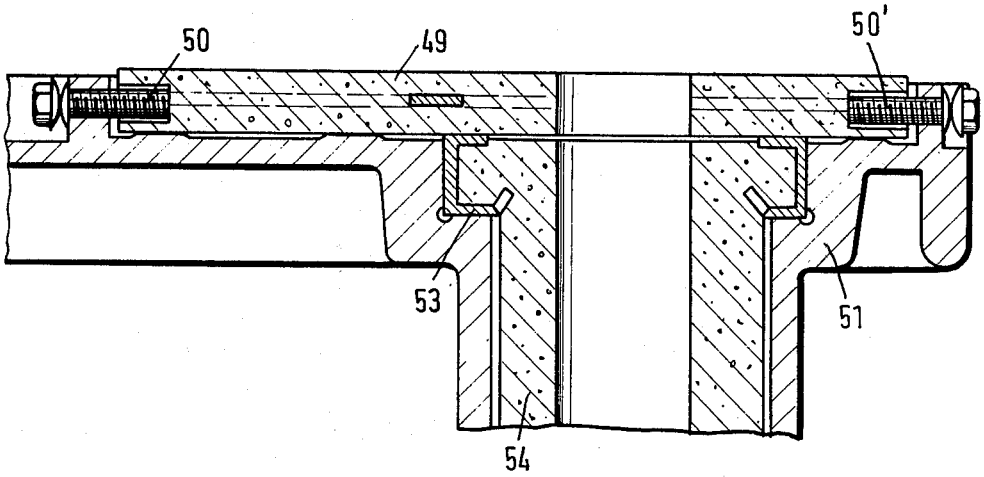
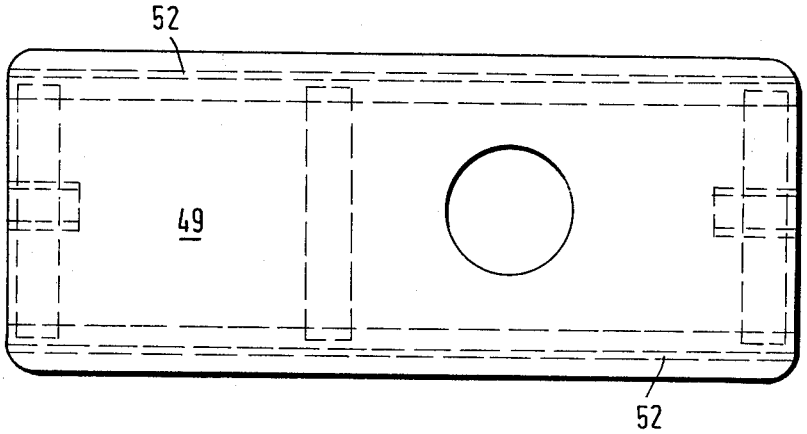
Fig.6a

SLIDING GATE NOZZLES

BACKGROUND OF THE INVENTION

The invention relates to a bottom gate for metallurgical vessels, more particularly a sliding gate, having interchangeable refractory wearing parts having at least one flow aperture.

The invention relates more particularly to sliding gates for a casting ladle or tundish for the casting of steel, including more particularly the continuous casting process.

After the limit of wear has been reached, the refractory wearing parts of bottom gates, more particularly sliding gates, must be replaced to ensure the security of the closure and obviate the risk of breakages.

In the casting of steel the wearing parts are particularly heavily stressed and must be exchanged relatively frequently. Changing the wearing parts always means that the bottom gates must be put out of operation, and for many years attempts have been made to reduce to a minimum the stoppage time of the bottom gate and associated vessel, for instance, the steel casting ladle.

When the wearing parts are changed special problems are raised by the incorporation of the fresh wearing parts, which must be incorporated and adjusted with great care.

DESCRIPTION OF THE PRIOR ART

German patent specification No. 1,783,174 discloses a method of incorporating the individual refractory wearing parts of adjustable bottom gates for steel casting ladles in which the individual refractory parts of the bottom gate are each inserted in their respective bed of mortar, whereafter they are adjusted to their final correct position therein by the application of axially applied pressure, while at the same time their aligned apertures are centered and their position is aligned.

Special devices have been suggested to help in the fitting of the refractory wearing parts, for instance, an auxiliary framework which can be used to align the individual wearing parts and locate them in the correct position in a bed of mortar.

SUMMARY OF THE INVENTION

It is an object of the invention to provide a bottom gate for metallurgical vessels, for which the wearing parts can be incorporated in a very simple manner without the use of special fitting, centering and positioning devices.

To this end the invention provides a bottom gate for metallurgical vessels, more particularly a sliding gate, having interchangeable refractory wearing parts having at least one flow aperture, in which the wearing parts consist of refractory concrete reinforced with metal parts, and parts of the reinforcement are disposed on areas of the surface of the wearing part which are remote from the metal melt, to center and position the wearing part.

DESCRIPTION OF THE PREFERRED EMBODIMENTS

Conveniently, each wearing part has at least one metal reinforcing part which is disposed in its surface and embedded in the refractory concrete.

In a special embodiment of the invention the reinforcing parts are so embedded in adjacent refractory concrete wearing parts as to ensure a centering fit or an operative contact.

The use of the invention enables the fresh wearing parts to be inserted in a very short time and reliably adjusted without the use of special devices after the worn wearing parts have been removed, since when the fresh wearing parts are introduced the metal reinforcing parts disposed on the surface of the wearing parts automatically produce centering and positioning. There is no need to use a previously prepared bed of mortar for the fitting of the wearing parts. Fitting is carried out without the use of mortar, which is required, only after the wearing parts have been adjusted, for sealing the assembled gate.

The mortar-free adjustment of the wearing parts speeds things up appreciably and obviates the previous errors which were liable to occur in the dimensioning of the bed of mortar. Use of the invention also increases the operating security of the gate, due to the very simple incorporation of the wearing parts.

The term "refractory concrete" used herein means a concrete based on mixtures containing fused high alumina cement which is hydraulically setting, and which is of substantially constant volume at the high temperatures involved, more particularly in the casting of steel. German Offlenlegungsschrift No. 26,24,299 discloses examples of a high alumina concrete of the kind specified.

In the bottom gate according to the invention it is important for the reinforcing parts disposed on the surface of the wearing parts to be rigidly connected thereto; this is made possible by the use of refractory concrete in which the wearing parts are partially embedded and if necessary anchored by projections or tongues extending into the refractory concrete. The reinforcing parts can have a shape adapted to the purpose in view, for instance take the form of plates, strips or rails, but they can also be of annular or tubular shape.

In a special embodiment of the invention the reinforcing parts dispossed on the surface of the wearing parts are in the form of screwthreaded members which if necessary can engage with matchingly screwthreaded parts of the bottom gates.

In a convenient embodiment of the invention a reinforcing part in the form of a ring with tangentially or radially projecting resilient tongues is associated with a wearing part, for instance, a perforated block, the resilient tongues engaging with an aperture in the bottom of a metallurgical vessel, for instance, a steel casting ladle and centering the wearing part and locating it in position.

To facilitate the removal of the used wearing parts, the lower ends of the reinforcing parts disposed on the surface of the wearing parts can be formed with recesses or projections for the engagement of tools or apparatuses for removing the wearing parts.

In this connection the wearing parts can be, for instance, the bottom brick, the nozzle brick sleeve, the fixed plate, the sliding plate, the discharge or the discharge block, the choke baffle in connection with the discharge, and immersion tubes or shadow tubes, all the wearing parts having at least one flow aperture for the metal melt. The metal reinforcing parts are basically disposed on the "cool" side—i.e., the side remote from the flow aperture—of the refractory concrete wearing part.

DESCRIPTION OF THE DRAWINGS

The invention can be put into practice in various ways and a number of specific embodiments will be described to illustrate it with reference to the accompanying drawings in which:

FIG. 6 is a section illustrating the mortar-free incorporation of the sliding plate and collector nozzle in a sliding gate according to the invention, FIG. 6*a* is a plan view of the sliding plate shown in FIG. 6.

DETAILED DESCRIPTION OF THE INVENTION

Figure 1:
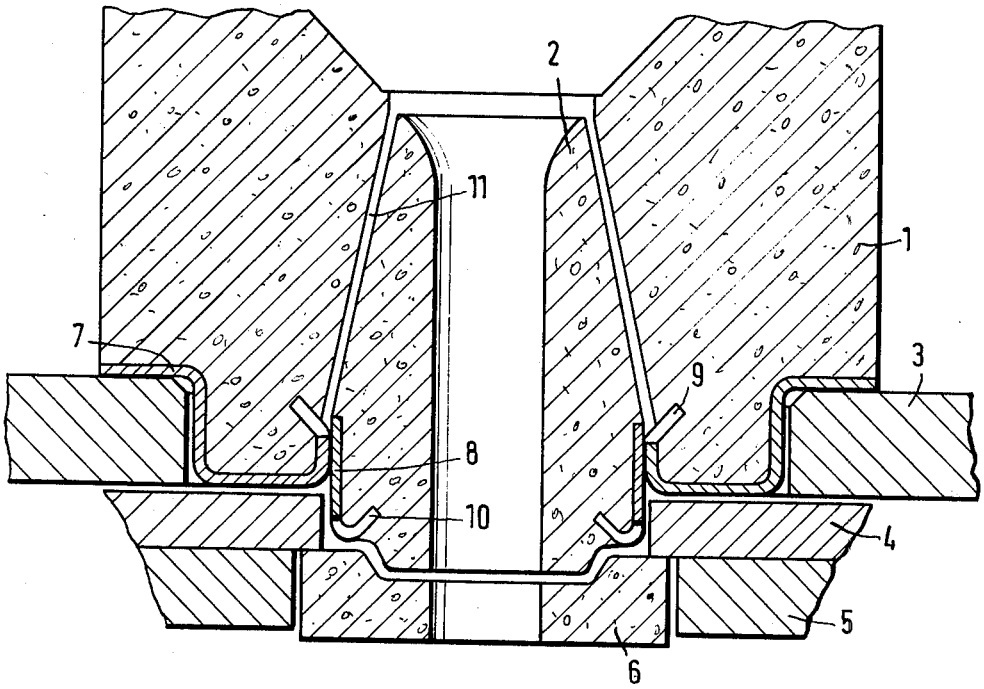
FIG. 1 is a partial section showing the centering of the nozzle brick in the bottom bricks of a casting ladle and the centering of the nozzle brick sleeve in the bottom brick.

FIG. 1 is a partial cross-section through the stationary parts of a sliding gate having a bottom brick 1 with a nozzle brick 2 inserted therein. The bottom brick 1 is borne on the bottom wall 3 of a metallurgical vessel, for instance, a steel casing ladle. A supporting ring 4 disposed beneath the bottom wall is connected to a casing part 5 of the sliding gate. The wall 3, the supporting ring 4 and the casing part 5 are made of metal. A fixed plate 6, whose flow aperture is aligned with the flow aperture in the nozzle brick 2 is disposed in the casing part 5. The bottom brick 1, the nozzle brick 2 and the fixed plate 6 are made of refractory concrete.

The bottom brick 1 and the nozzle bricks 2 have metal reinforcements 7, 8 which are disposed in the surface zone of the refractory concrete parts. The metal reinforcements 7, 8 are disposed in those surface areas which are remote from the flow aperture for the melt, therefore lying on the "cool" side of the bottom brick 1 and the nozzle brick 2. The metal reinforcements 7, 8 cover after the fashion of a jacket a portion of that surface of the bottom brick 1 and nozzle bricks 2 which lie on the "cool" side.

The metal reinforcement 7 covers the underside and a portion of the peripheral wall of the conical flow aperture of the bottom brick 1. The metal reinforcement 7 has the form of a continuous ring whose cross-sectional profile is adapted to the outline of the bottom brick 1 which is to be covered. The inner periphery of the annular metal reinforcement 7, such periphery bearing against the peripheral wall of the conical flow aperture, has retaining tongues 9 which are bent over and embedded in the refractory concrete. In this way the annular metal reinforcement 7 is rigidly connected to the refractory concrete of the bottom brick 1. The metal reinforcement 8 takes the form of a cylindrical tubular member which encloses a cylindrical portion of the nozzle brick 2. At one of its ends the cylindrical metal reinforcement 8 also has bent-over retaining tongues 10 which are embedded in refractory concrete and connect the metal reinforcement 8 rigidly to the nozzle brick 2.

As can be gathered from FIG. 1, those surfaces of the bottom brick 1 which engage with the wall 3 are covered by the metal reinforcement 7. The annular metal reinforcements 7 simultaneously fulfil two purposes, on the one hand acting as a reinforcement for the bottom brick 1 and on the other hand enabling the bottom brick and nozzle brick to be adjusted in a very simple manner.

The nozzle brick 2 is inserted from below into the conical flow aperture of the bottom brick 1. When the cylindrical metal reinforcement, extending around the outer periphery of the nozzle brick 2, engages with that portion of the metal reinforcement 7 which is bent over and bears against the wall of the conical flow aperture in the bottom brick 1, the nozzle brick 2 is automatically centered and located in the correct position. The mutual engagement of the metal reinforcements 7, 8 of the bottom brick 1 and the nozzle brick 2 is enough to align the two wearing parts in the required position. There is therefore no longer any need for special devices for centering and axial location when a new bottom brick 1 and a new nozzle brick 2 are inserted.

Before the nozzle brick 2 is inserted in the bottom brick 1 and adjusted, conveniently for the remaining annular gap 11 sealing mortar is applied on the outside to the top end of the nozzle brick 2, to provide the necessary seal against the liquid steel. The insertion, adjustment and aligning of the wearing parts substantially facilitates and speeds up the replacement of wearing parts.

Figure 2:
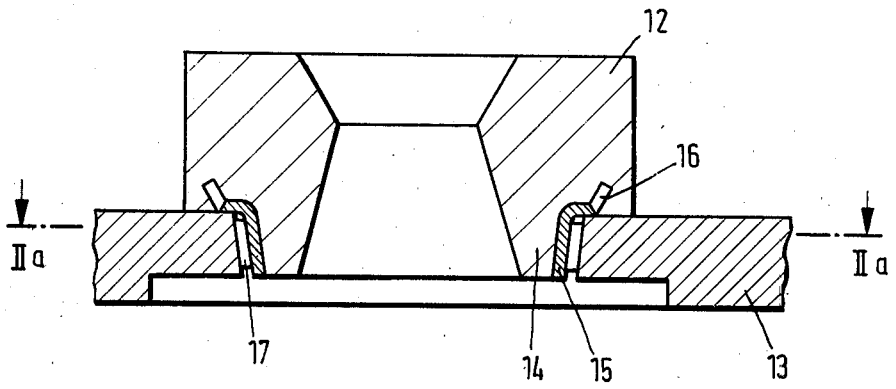
FIG. 2 is a section through a nozzle brick which is adjusted and located in the fixed plate of a sliding gate by the use of a metal reinforcement.

FIG. 2 is a cross-section through a nozzle brick which has a variant metal reinforcement and a throat. The nozzle brick 12 shown in FIG. 2 is inserted in a baseplate or the bottom wall of the vessel 13. The annular portion 14 of the nozzle brick 12 extending in the hole in the baseplate 13 has on its outer periphery an annular metal reinforcement 15 having the shape of a cone-like part. The annular reinforcement 15 has bent-over retaining tongues 16 which are embedded in the refractory concrete of the nozzle brick 12. The annular reinforcement 15 also has resilient tongues 17 which project from the periphery and engage resiliently with the wall of the aperture in the baseplate 13.

Figure 2A:
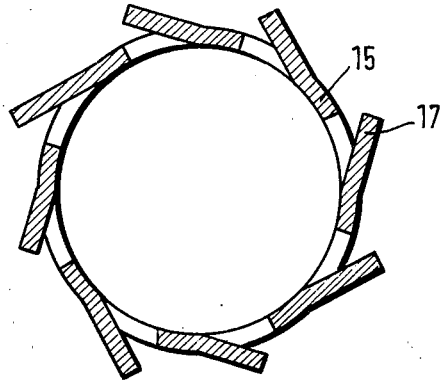
FIG. 2*a* is a section, taken along the line II*a*—II*a* in FIG. 2, through the metal reinforcement showing the centering tongues.

FIG. 2*a* is a cross-section, taken along the line II*a*—*IIa* through the annular reinforcement 15. As FIG. 2*a* clearly shows, the resilient tongues 17 are punched out of the peripheral wall of the annular reinforcement 15 and bent outwards. In this way the resilient tongues 17 tangentially of the outer periphery of the annular ring reinforcement 15 and are so disposed that they all point in the same direction.

Figure 2B:
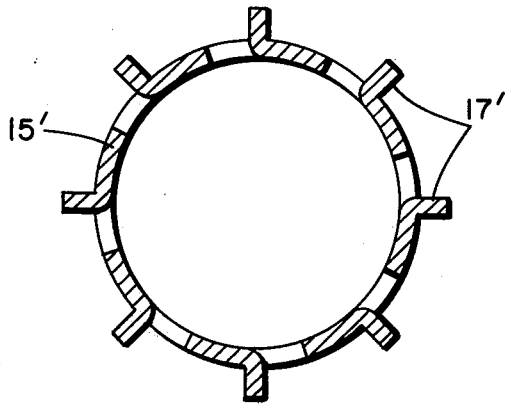
FIG. 2*b* is a section of a metal reinforcement showing the centering tongues in a radial position.

FIG. 2*b* shows the resilient tongues 17' extending radially from the outer periphery of the annular ring reinforcement 15'.

The nozzle brick 12 to be inserted is forced by its annular portion 14 and the reinforcement 15 disposed thereon into the conical aperture in the baseplate 13. The resilient tongues 17 of the reinforcement 15 enter into resilient engagement with the wall of the conical aperture in the baseplate 13, so that the brick 12 is centered in the aperture in the baseplate 13 and at the same time located in position.

Figure 3:
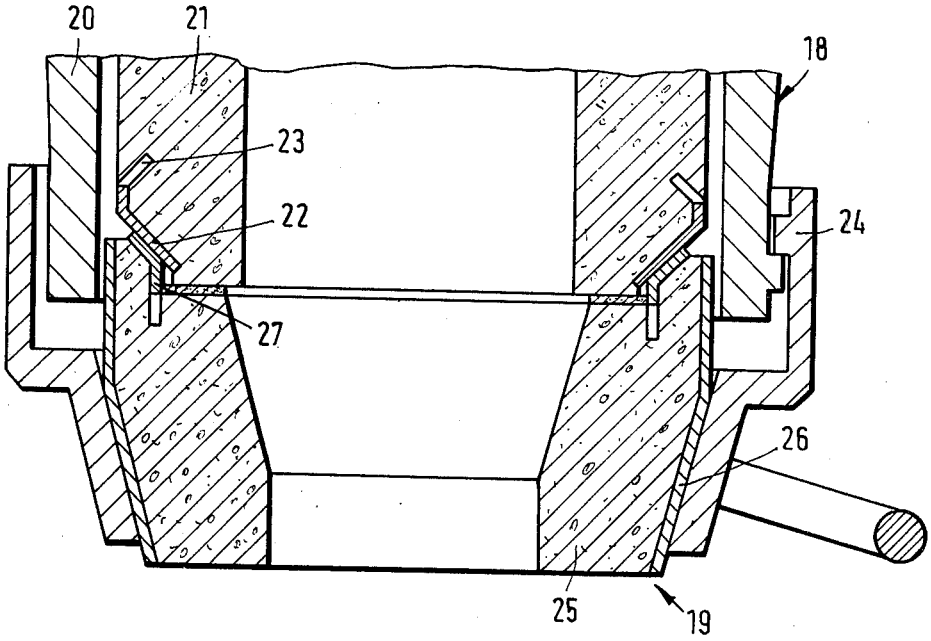
FIG. 3 is a section through part of a collector nozzle with an attached choke baffle.

FIG. 3 is a cross-section through the bottom end of a discharge member 18, to which a choke baffle 19 is releasably attached to control the discharge of the melt. The discharge member 18 has a metal jacket 20 and a refractory concrete collector nozzle 21 having at its bottom, exposed end an annular metal reinforcement 22 which is disposed on a surface remote from the flow aperture. The annular reinforcement 22 has a cylindrical part and a conical part and is rigidly connected to the collector nozzle 21 via bentover retaining tongues 23. The choke baffle 19 has a screw collar ring 24 connected via a bayonet connection to the jacket 20 of the discharge member 18. The screw collar ring 24 bears a refractory concrete choke insert 25 having two annular metal reinforcements 26, 27. The annular metal reinforcement 26 extends around the whole outer periphery of the choke insert 25 and is connected to the screw collar ring 24. The annular metal reinforcement 27 contacts the annular metal ring reinforcement 22 of the collector nozzle 21 of the discharge member 18.

When the choke baffle 19 is attached to the discharge member 18 by means of a screw collar ring 24, the interengaging annular reinforcements 22, 27 of the collector nozzle 21 and the choke insert 25, and the engagement of the annular metal reinforcement 26 with the screw collar ring 24, result in the adjustment and centering of the choke baffle 19 with the discharge member 18.

Figure 4:
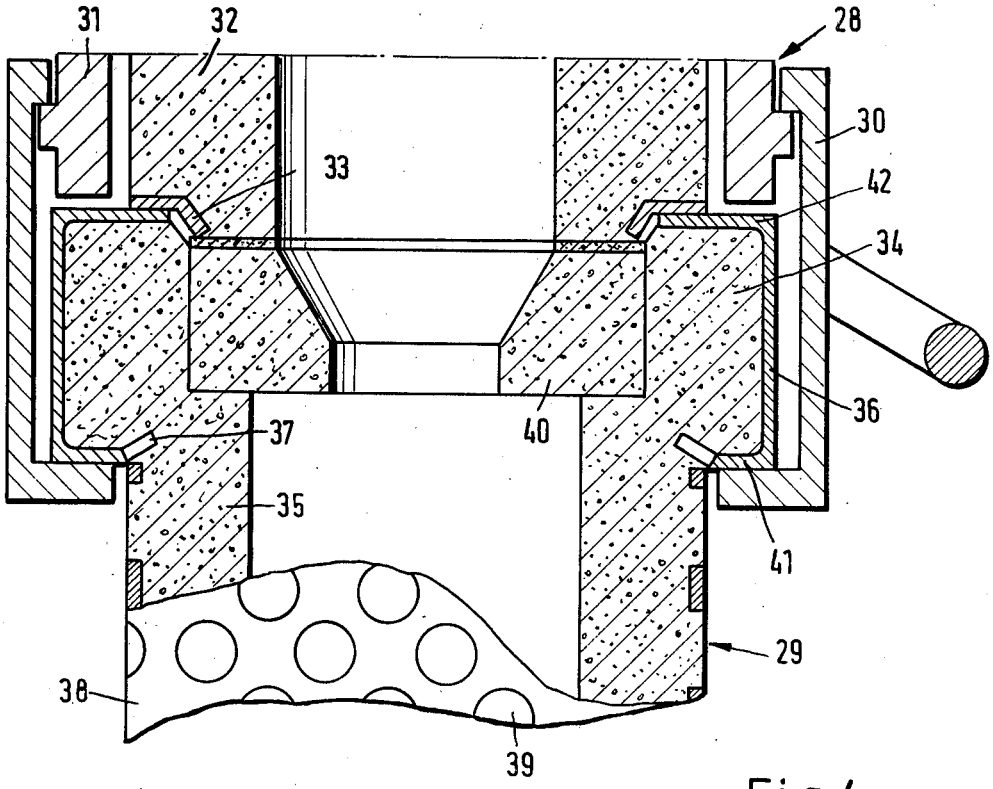
FIG. 4 is a section through part of a discharge nozzle with an attached immersion tube, in whose head a choke baffle is disposed.

FIG. 4 is a cross-section through the bottom end of a discharge member 28 at whose bottom end an immersion tube 29 is releasably attached via a screw collar ring 30. The releasable connection between the screw collar ring 30 and the discharge member 28 is effected via a bayonet closure. The discharge member 28 has a metal jacket 31 and a refractory concrete connector nozzle 32. The bottom, exposed end of the collector nozzle 32 has an annular reinforcement 33 which is disposed on a surface zone remote from the flow aperture.

At its end adjacent the discharge member 28 the immersion tube 29 has a radially outwardly projecting collar 34 which engages with the screw collar ring 30. The immersion tube 29 comprises a refractory concrete member 35 whose radially outwardly projecting collar 34 is enclosed by an annular metal reinforcement 36. The annular metal reinforcement 36 has retaining tongues 37 which are embedded in the concrete member 35 and connect the annular reinforcement rigidly thereto. The annular reinforcement 36 of the immersion tube 29 engages on the one hand with the annular reinforcement 33 of the collector nozzle 32 of the discharge member 28 and on the other with the screw collar ring 30. The portion of the concrete member 35 which adjoins the collar 34 is enclosed by a perforated sheet metal jacket 38. The material of the concrete member 35 can enter the holes 39 in the perforated sheet metal jacket 38 and form a closure flush with the outer surface of the perforated sheet metal jacket 38, so as to produce a firm anchoring between the concrete member 35 and the perforated sheet metal jacket 38. At its top end, adjacent the discharge member 28, the concrete member 35 of the immersion tube 29 has a stepped recess into which a choke insert 40 is inserted to control the discharge of the metal.

When the immersion tube 29 is attached to the bottom end of the discharge member 28 by means of the screw collar ring 30, the latter seizes the bottom, radially inwardly directed flange 41 of the annular reinforcement 36, so that the immersion tube 29 is pulled upwards and the top flange 42 of the annular reinforcement 36 is forced against the annular reinforcement 33 of the collector nozzle 32 of the discharge member 28. The annular metal reinforcements 33, 36 of the collector nozzle 32 and of the immersion tube 29 on the one hand reinforce the refractory concrete wearing parts and on the other have the advantage that the wearing parts to be interconnected are aligned in relation to one another and can be interconnected with the necessary prestressing.

Figure 5:
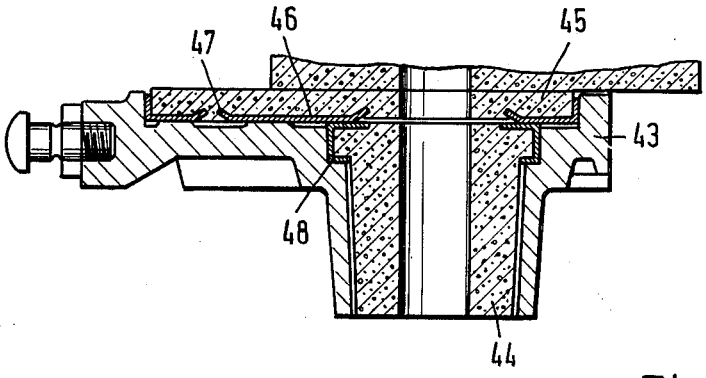
FIG. 5 is a section through part of a sliding gate with the sliding plate and collector nozzle in the slider casing.

FIG. 5 is a cross-section through the movable part of a sliding gate. The movable part of the sliding gate has a metal casing 43 containing a collector nozzle 44 and a sliding plate 45 having upon its underside, adjacent the collector nozzle 44, a metal reinforcement 46 connected via retaining tongues 47 to the refractory concrete sliding plate 45. That side of the collector nozzle 44 which is adjacent to the sliding plate 45 also has a metal reinforcement 48 which can be brought into operative engagement with the metal reinforcement 47, to locate the collector nozzle 44 and sliding plate 45 in relation to one another. An annular disc of refractory felt (fibrous material) is inserted in the gap around the flow aperture between the sliding plate 45 and the collector nozzle 44 to ensure a seal against the metal melt.

FIG. 6 is a cross-section, similar to FIG. 5, through the movable part of a sliding gate. The casing has a sliding plate 49 which is retained by spring-prestressed adjusting pins 50, 50' in the casing 51 and has embedded angle rails 52 (FIG. 6*a*) which extend along the plate and whose arms lie in the surface thereof. The angle rails 52 engage operatively with an annular reinforcement 53 of U-shaped cross-section which is embedded in a refractory concrete collector nozzle 54.

Figure 7:
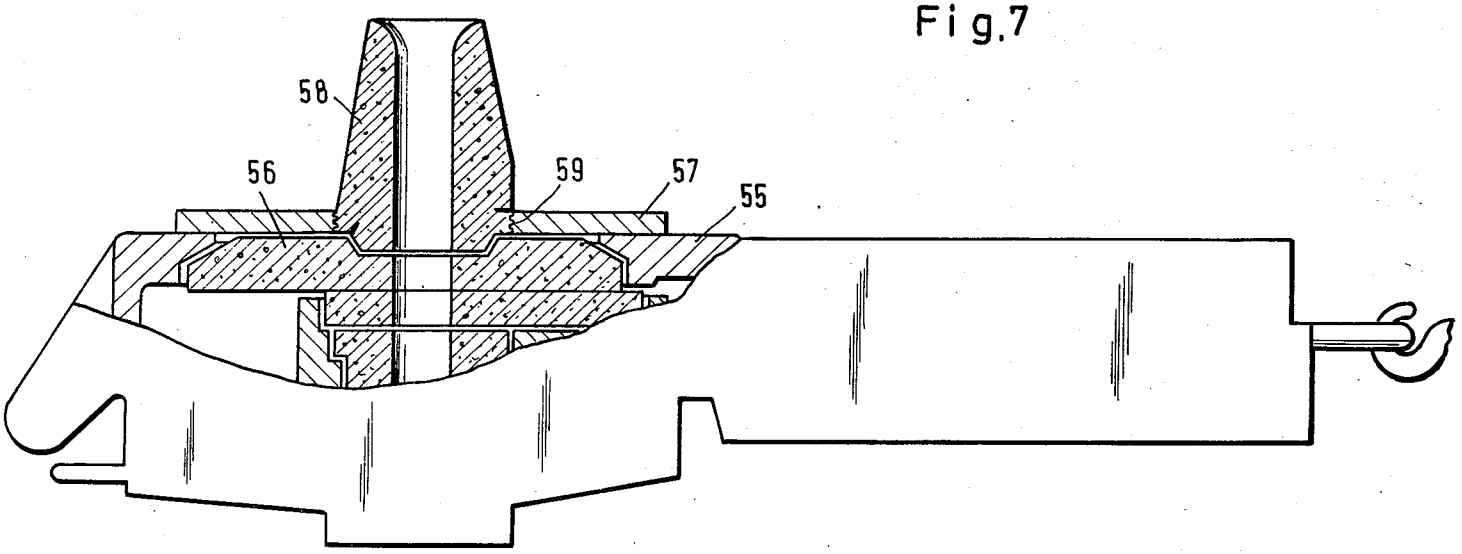
FIG. 7 illustrates an embodiment of the invention in the form of a "cassette-type slider casing" in which a reinforcing part disposed on the nozzle brick has a screwthreading.

FIG. 7 is a partial longitudinal section through a sliding gate which can be attached to a metallurgical vessel. The sliding gate has a metal casing 55, a fixed plate 56 and a bearing ring 57. In this embodiment the sliding gate is connected to a refractory concrete nozzle brick 58 having at one end of its cylindrical outer periphery an annular reinforcement 59 whose cross-section has the form of screwthreading.

Figure 8:
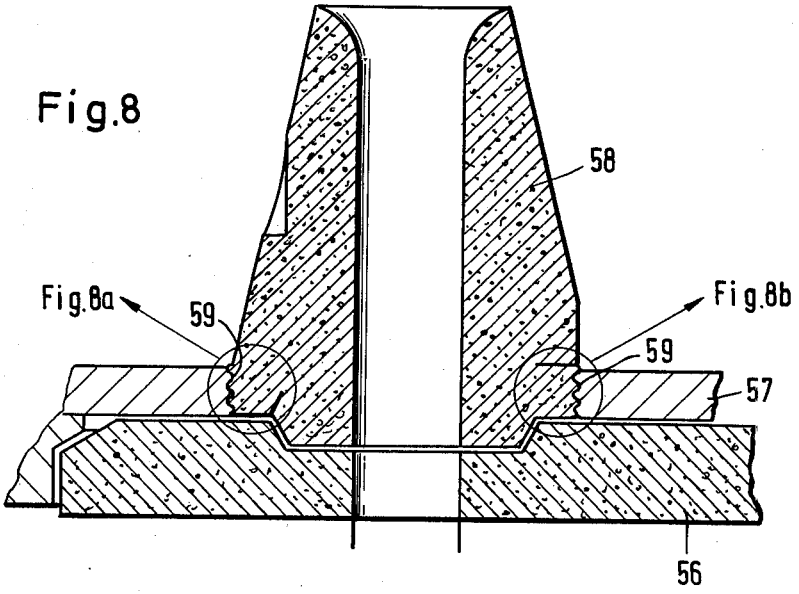
FIG. 8 is an enlarged view of part of FIG. 7, showing the engagement of the screwthreaded reinforcing part in part of the slider casing.
Figure 8A:
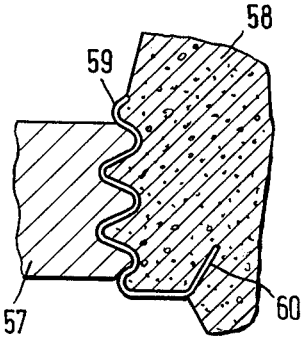
FIGS. 8*a* and 8*b* show to an enlarged scale the embodiment of the screwthreaded reinforcing part illustrated in FIG. 8.
Figure 8B:
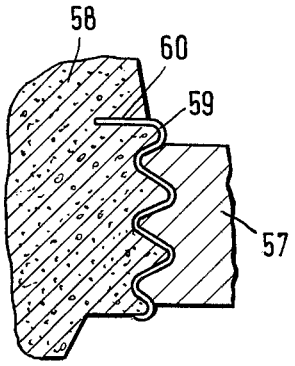

As can be seen in greater detail from FIGS. 8, 8*a* and 8*b*, the annular metal reinforcement 59 is screwed by the cross-section of a screwthreading into a matching screwthreading of the bearing ring 57. The annular reinforcement 59 is embedded by means of retaining tongues 60 in the refractory concrete of the nozzle brick 58. As shown in FIGS. 8*a* and 8*b*, the retaining tongues 60 of the annular reinforcement 59 can be disposed optionally on the side of the sleeve 58 adjacent the fixed plate 56, or on the side of the sleeve 58 adjacent the metallurgical vessel.

Figure 9:
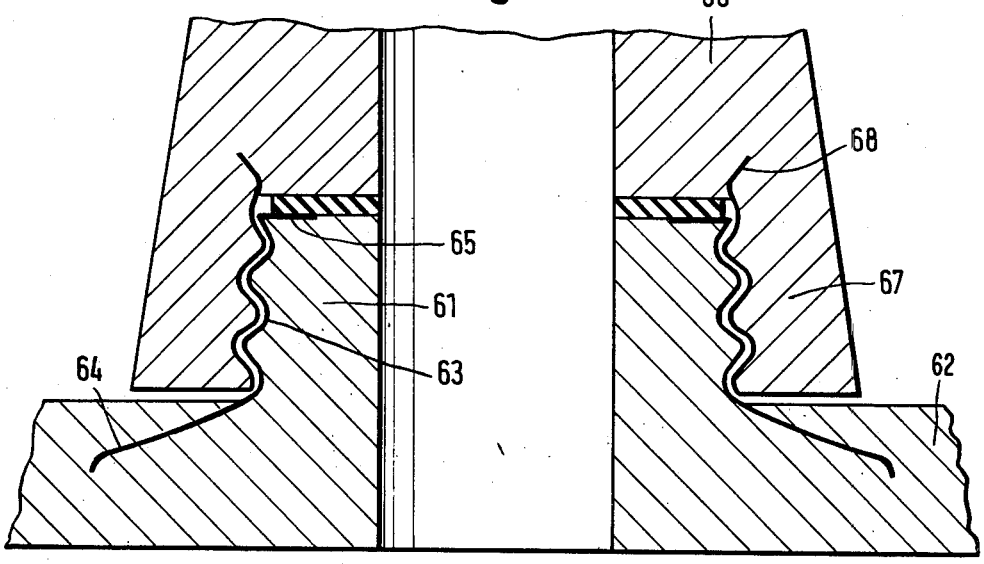
FIG. 9 is another section through an embodiment of the invention with screwthreaded reinforcing parts.

FIG. 9 shows an embodiment of the sliding gates illustrated in FIGS. 7 and 8. In the embodiment illustrated in FIG. 9, a fixed plate 62 has a projecting attachment 61 directed towards the nozzle brick (not shown). The attachment 61 of the refractory concrete fixed plate 62 is enclosed by an annular metal reinforcement 63 whose cross-section has the form of a screw-threading. The annular reinforcement 63 is embedded by its bottom end 64 in the fixed plate 62. The head end 65 of the annular reinforcement 63 forms a part of the horizontal surface of the attachment 61 of the fixed plate 62. A nozzle brick 66 has a portion 67 which engages over the attachment 61 and has on the side adjacent the portion 61 an annular metal reinforcement 68 whose cross-section has the form of a screwthreading. The annular reinforcement 68 and the annular reinforcement 63 have matching cross-sectional shapes, so that the nozzle brick 66 can be screwed on to the attachment 61 of the fixed plate 62. Sealing against the melt is provided, for example, by refractory felt.

Figure 10:
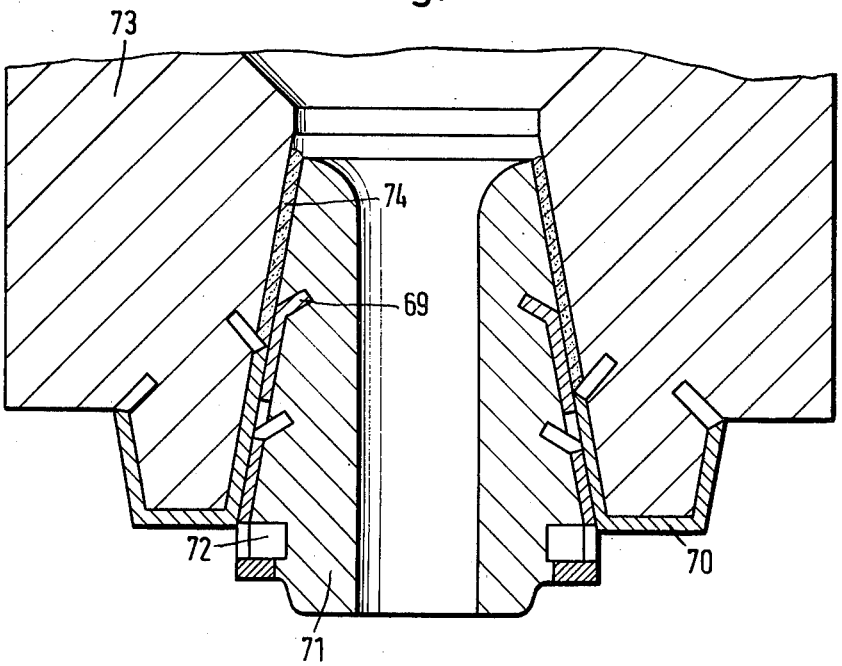
FIG. 10 shows a nozzle brick inserted in a bottom brick; both the bottom brick and the nozzle bricks have metal reinforcements, and recesses are provided for the engagement of tools in the nozzle brick.

FIG. 10 shows a further embodiment of a nozzle brick 71 inserted in a bottom brick 73. The bottom brick 73 and nozzle brick 71 have on a portion of their facing surfaces annular metal reinforcements 69, 70 which allow independent adjustment and operative engagement. The annular gap 74 left after the insertion and adjustment of the nozzle brick 71 is conveniently filled with refractory mortar to produce a satisfactory seal. In this embodiment the nozzle brick 71 is fitted into the bottom brick 73 by the same principle as that described with relation to the embodiment illustrated in FIG. 1. At the end adjacent the sliding gate the metal reinforcement 69 of the nozzle brick 71 has recesses 72 for the engagement of tools or hydraulic apparatuses to remove the sleeve from the brick.

Figure 11:
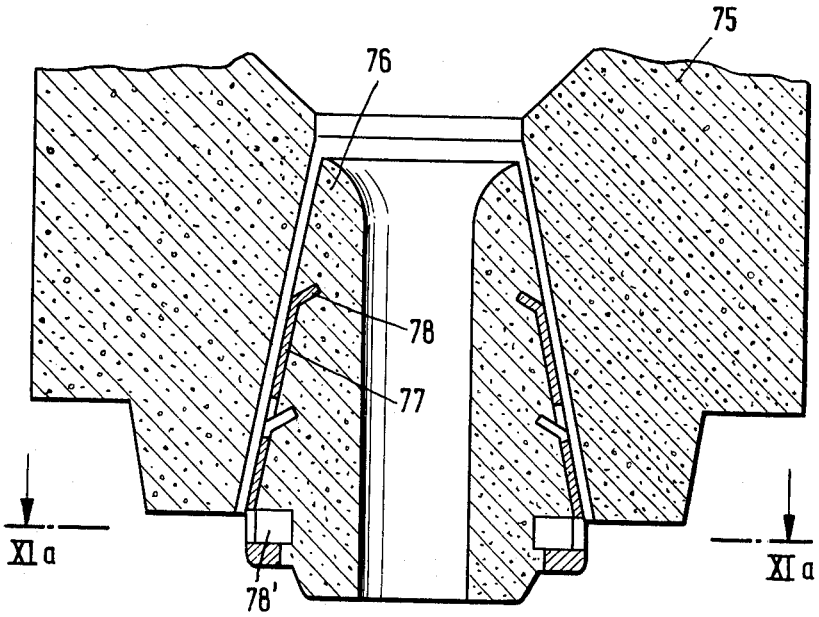
FIG. 11 illustrates a variant embodiment in which the metal reinforcement and the refractory concrete sleeve body are formed with recesses for the engagement of a tool or withdrawal apparatus, but in which the bottom brick has no reinforcement.

FIG. 11 illustrates an embodiment, similar to FIG. 10, of a nozzle brick 76 inserted in a bottom brick 75. On the surface remote from the flow aperture the nozzle brick 76 has annular metal reinforcement 77 anchored by means of retaining tongues 78 in the refractory concrete of the nozzle brick 76. The retaining tongues 78 embedded in the refractory concrete can be bent inwards from the wall of the annular reinforcement 77. The surface of the annular reinforcement 77 on the nozzle brick 76 is flush with the other refractory concrete surface of the nozzle brick 76.

Figure 11A:
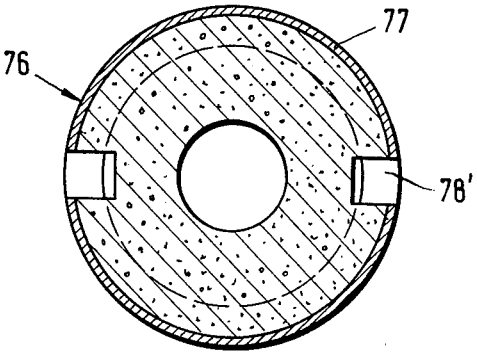
FIG. 11*a* is a cross-section, taken along the line XI*a*—XI*a*, through the embodiment illustrated in FIG. 11.

The bottom end of the annular metal reinforcement 77 adjacent the sliding gate, has recesses 78' for the engagement of tools or hydraulic apparatus for removing the nozzle brick 76 from the bottom brick 75. The recesses 78' are distributed uniformly over the periphery. As a rule two opposite recesses 78' are provided, as can be seen in FIG. 11*a*. However, move than two recesses can also be provided in the annular reinforcement 77 for the engagement of removal tools.

In the embodiment illustrated in FIG. 11 the bottom brick 75 has no metal reinforcement on the surface adjacent the nozzle brick 76. Conveniently, before the nozzle brick 76 is inserted, the outer peripheral wall of the nozzle brick 76 is coated with a layer of refractory mortar, to produce a satisfactory seal between the nozzle brick 76 and the bottom brick 75.

Figure 12:
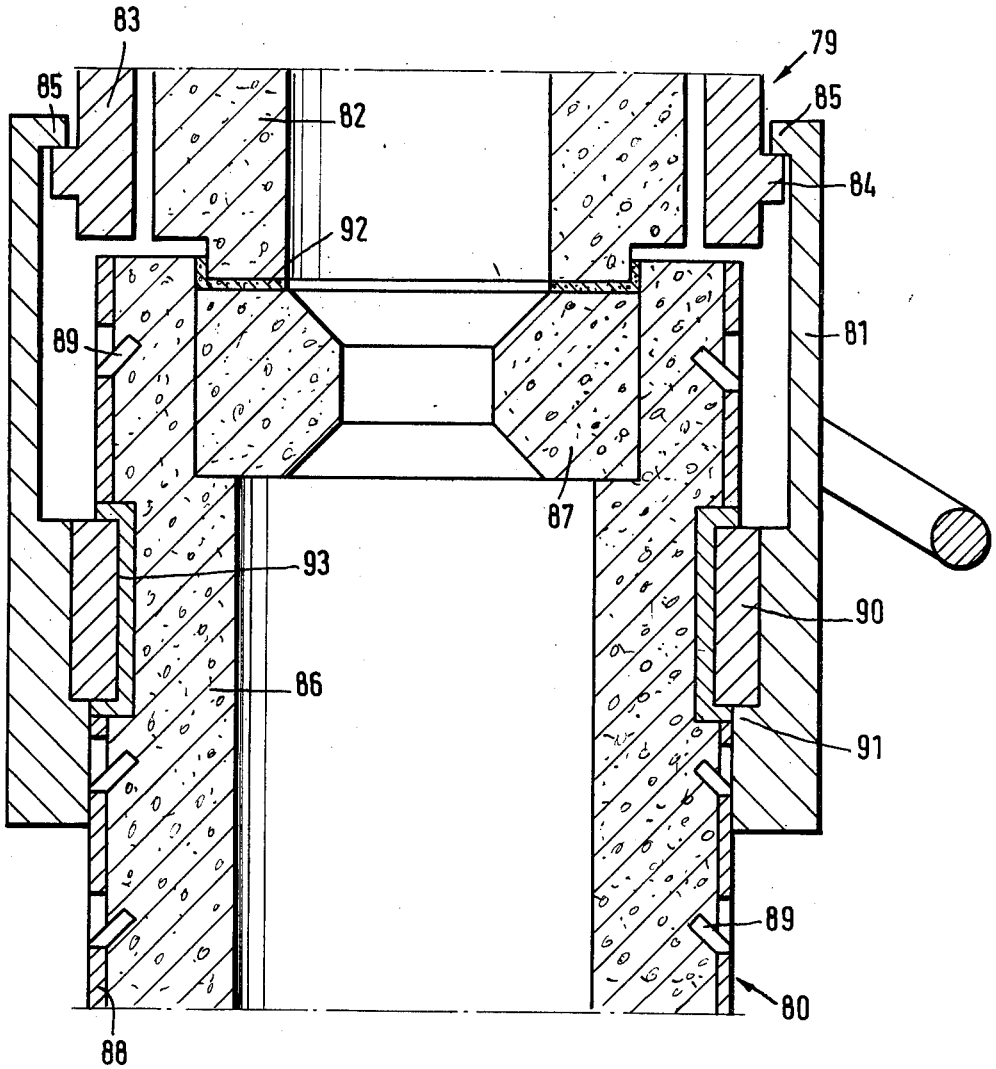
FIG. 12 is a section through a part of a collector nozzle with an attached immersion tube which contains a choke baffle, the drawing illustrating the attachment of the immersion tube, which has a metal reinforcement.

FIG. 12 is a cross-section through the bottom end of a discharge member 79 to whose bottom end an immersion tube 80 is releasably attached by a screw collar ring 81. The discharge member 79 has a collector nozzle 82 of refractory concrete and a metal jacket 83, having a number of collar-like projecting portions 84 which are distributed over the outer periphery and co-operate in the fashion of a bayonet-type closure with a number of peripherally distributed, radially inwardly directed flange portions 85 of the screw collar ring 81.

The immersion tube 80 has a tubular refractory concrete member 86 which has at its top end, adjacent the discharge member 79, an inserted choke member 87 of refractory material. The tubular refractory concrete member 86 of the immersion tube 80 is jacketed by a cylindrical metal reinforcement 88 which is disposed on its outer periphery and has bentover retaining tongues 89 embedded in the refractory concrete member 86. The cylindrical metal reinforcement 88 has a groove-like recess 93 which extends around the periphery and into which a retaining ring 90 comprising two parts or shells is inserted. A radially inwardly directed peripheral flange 91 of the screw collar ring 81 engages with the retaining ring 90.

When the screw collar ring 81 is attached to the immersion tube 80 by means of the half shells 90, the immersion tube 80 can be attached to the discharge member 79 by means of the bayonet-type closure formed by members 84, 85, the choke member 87 being prestressed against the collector nozzle 82. Adequate sealing is provided by an intermediate layer 92 of fibrous refractory material between the choke member 87 and the collector nozzle 82.

The co-operation between the cylindrical metal reinforcement 88 of the immersion tube 80 and the retaining ring 90 and screw collar ring 81 enables the immersion tube 80 with its choke member 87 to be centered and located in relation to the discharge member 79. Even with this embodiment of the invention, therefore, wearing parts can be very simply and quickly brought into the correct position without the use of special mounting devices, and located in that position by the necessary contact pressure.

The invention is not limited to wearing parts which are completely made of refractory concrete. The essential thing is that those sides of the wearing parts which bear the reinforcing parts and are remote from the flow aperture are made of refractory concrete. In contrast, the walls of the flow tube can be made of some other, for instance, even higher quality refractory material such as, for instance, magnesite, embedded as an insert in the refractory concrete member.

The reinforcing members are conveniently made of steel plate.

What I claim as my invention and desire to secure by Letters Patent is:

1. An interchangeable refractory wearing part having at least one flow aperture for molten metal consisting of refractory concrete reinforced with a metal reinforcement surrounding said aperture, a surrounding portion of the reinforcement being disposed on a wearing surface of said part remote from the flow aperture, said reinforcement disposed on a wearing surface being in the form of a ring axially disposed of said part and has tangentially projecting resilient tongues adapted to center and position the wearing part.

2. A bottom gate for a metallurgical vessel incorporating at least one interchangeable wearing part as claimed in claim 1.

3. An interchangeable refractory wearing part in the form of a bottom brick having a metallic reinforcement embedded by tongues of metal bent out of the reinforcement into the refractory concrete body, the metallic reinforcement providing a bottom surface, an outer peripheral surface shaped to engage a wall of a vessel adjacent an aperture therein and an inner peripheral surface shaped to engage a nozzle brick.

4. The bottom brick as claimed in claim 3, in combination with a nozzle brick of refractory concrete, an outer peripheral metallic reinforcement embedded by tongues of metal bent out of the reinforcement into the refractory concrete body, the inner peripheral surface of the reinforcement of the bottom brick and the outer peripheral metallic reinforcement of the nozzle brick being shaped and dimensioned so as to engage each other with the nozzle brick nesting in the bottom brick.

5. An interchangeable nozzle brick having at least one flow aperture for molten metal and consisting of a refractory concrete body having a metallic reinforcement embedded by tongues of metal bent out of the reinforcement into the refractory concrete body surrounding said aperture, a surrounding portion of the reinforcement being disposed on a wearing surface of said nozzle brick remote from the flow aperture and adapted to center and position said nozzle brick with respect to a bottom brick.

6. An interchangeable refractory wearing part having at least one flow aperture for molten metal and consisting of refractory concrete reinforced with a metal reinforcement surrounding said aperture, a surrounding portion of the reinforcement being disposed on a wearing surface of said part remote from the flow aperture and adapted to center and position the wearing part, said wearing part being in the form of a fixed plate having a boss in its upper surface affording a screwthreaded outer peripheral profile provided by the metallic reinforcement at least one extremity of which is embedded in the refractory concrete body.

7. An interchangeable immersion nozzle having at least one flow aperture for molten metal and consisting of refractory concrete reinforced with a metal reinforcement in the form of an outer perforated jacket surrounding said aperture, said jacket being disposed on a wearing surface of said nozzle remote from the flow aperture and adapted to center and position the nozzle, said jacket having tongues projecting therefrom.

8. A wearing part as claimed in claim 7, wherein said metal reinforcement having tongues is in the form of a jacket extending over at least part of its surface and has said tongues of metal bent out of the reinforcement into the refractory concrete body.

9. A metallurgical vessel incorporating at least one interchangeable wearing part as claimed in claim 3, or claim 5, or claim 4, or claim 6, or claim 7 or claim 8.

* * * * *